US010697235B2

(12) United States Patent
Santilli

(10) Patent No.: US 10,697,235 B2
(45) Date of Patent: Jun. 30, 2020

(54) UNIDIRECTIONAL WINDER

(71) Applicant: Rollease Acmeda Pty Ltd, Broadmeadows Victoria (AU)

(72) Inventor: Riccardo Santilli, Reservoir Victoria (AU)

(73) Assignee: Rollease Acmeda Pty Ltd, Broadmeadows VIC (AU)

( * ) Notice: Subject to any disclaimer, the term of this patent is extended or adjusted under 35 U.S.C. 154(b) by 196 days.

(21) Appl. No.: 15/552,059

(22) PCT Filed: Feb. 19, 2016

(86) PCT No.: PCT/AU2016/000053
§ 371 (c)(1),
(2) Date: Aug. 18, 2017

(87) PCT Pub. No.: WO2016/131087
PCT Pub. Date: Aug. 25, 2016

(65) Prior Publication Data

US 2018/0187481 A1 Jul. 5, 2018

(30) Foreign Application Priority Data

Feb. 19, 2015 (AU) ..... 2015900566

(51) Int. Cl.
*E06B 9/42* (2006.01)
*E06B 9/50* (2006.01)
(Continued)

(52) U.S. Cl.
CPC ..... *E06B 9/42* (2013.01); *E06B 9/50* (2013.01); *E06B 9/56* (2013.01); *E06B 9/78* (2013.01);
(Continued)

(58) Field of Classification Search
CPC ..... E06B 9/42; E06B 9/50; E06B 9/56; E06B 9/78; E06B 9/80; E06B 2009/2452; E06B 2009/405; E06B 2009/785
See application file for complete search history.

(56) References Cited

U.S. PATENT DOCUMENTS 5,566,741 A * 10/1996 Ogawara ..... E06B 9/90 160/297
6,158,563 A * 12/2000 Welfonder ..... E06B 9/90 160/291
(Continued)

FOREIGN PATENT DOCUMENTS

JP H10-176471 6/1998
JP 2015-140632 8/2015

*Primary Examiner* — Katherine W Mitchell
*Assistant Examiner* — Abe Massad
(74) *Attorney, Agent, or Firm* — Head, Johnson, Kachigian & Wilkinson, PC

(57) ABSTRACT

A winder for a blind system, comprising a drive member rotatable in a drive direction and a free direction; a driven member to engage a blind cylinder; a transmission mechanism to selectively transmit rotation of the drive member to the driven member, the transmission mechanism including an intermediate transmission member and an intermediate resistor to provide resistance to rotation of the intermediate transmission member, wherein the transmission mechanism has a drive state when the drive member is rotated in the drive direction to overcome the resistance of the intermediate resistor and transmit rotation of the drive member through the intermediate transmission member to the driven member, and a free state when the drive member is rotated in the free direction, wherein transmission is broken between the drive member and the intermediate transmission member and intermediate resistor.

26 Claims, 12 Drawing Sheets

(51) Int. Cl.

| | |
|---|---|
| ***E06B 9/56*** | (2006.01) |
| ***E06B 9/78*** | (2006.01) |
| ***E06B 9/80*** | (2006.01) |
| *E06B 9/40* | (2006.01) |
| *E06B 9/24* | (2006.01) |

(52) U.S. Cl.
CPC ..... *E06B 9/80* (2013.01); *E06B 2009/2452* (2013.01); *E06B 2009/405* (2013.01); *E06B 2009/785* (2013.01)

(56) References Cited

U.S. PATENT DOCUMENTS

| | | | | |
|---|---|---|---|---|
| 7,497,242 | B2 * | 3/2009 | Wang | E06B 9/42 160/238 |
| 8,191,605 | B2 * | 6/2012 | Kwak | E06B 9/42 160/193 |
| 8,356,653 | B2 * | 1/2013 | Fu-Lai | E06B 9/322 160/170 |
| 8,757,237 | B2 | 6/2014 | Aoki | |
| 9,341,020 | B1 * | 5/2016 | Kao | E06B 9/262 |
| 2006/0027339 | A1 | 2/2006 | Hsu | |

* cited by examiner

UNIDIRECTIONAL WINDER

FIELD

The present invention relates generally to a winder for a blind system. It has particular application to dual blind systems, but the invention is not limited to that application, and may readily be used in single blind systems.

BACKGROUND

In this specification where a document, act or item of knowledge is referred to or discussed, this reference is not an admission that the document, act or item of knowledge or any combination thereof was at the priority date, publicly available, known to the public, part of the common general knowledge; or known to be relevant to an attempt to solve any problem with which this specification is concerned.

A winder assembly refers to blind component (or fitting) that is rotatable to, for example, extend and retract a window covering such as a window blind. Such fittings typically have a drive member that is rotatable about a spindle, and engages a cord (for example, a beaded cord or chain). Operation of the cord, by a user, causes the drive member to rotate about the spindle, and a drive mechanism causes that rotation to be transmitted to a blind cylinder.

To extend the blind, the cord is generally pulled in one direction, which rotates the fitting and extends the blind. However, retraction of the blind may sometimes be accomplished using a different mechanism—for example, retraction of the blind may be spring boosted, such that tugging on the blind or on the cord in a blind extending direction releases the blind and causes it to automatically retract. Such systems therefore only require the cord to be pulled in one direction (a blind extending direction).

Dual blind systems have been developed which use two blinds (a front blind and a back blind) to cover a single window. For example, one blind may be made of sheer or partially transparent fabric, which allows natural light to pass through, and the other blind may be a block-out blind which effectively blocks out light passing through the window and affords privacy.

Generally, a dual blind system will use two winders—one for each blind. However, the system may only require a single cord to operate both winders—pulling the cord in one direction operates one winder to extend the associated blind, and pulling the cord in the opposite direction operates the other winder to extend the other blind. The winder of the present invention is particularly suitable for such a system.

SUMMARY

According to a first aspect of the present invention, there is provided a winder for a blind system, comprising:

a drive member rotatable in a drive direction and a free direction;

a driven member to engage a blind cylinder a transmission mechanism to selectively transmit rotation of the drive member to the driven member, the transmission mechanism including an intermediate transmission member and an intermediate resistor to provide resistance to rotation of the intermediate transmission member, wherein the transmission mechanism has:

a drive state when the drive member is rotated in the drive direction to overcome the resistance of the intermediate resistor and transmit rotation of the drive member through the intermediate transmission member to the driven member, and a free state when the drive member is rotated in the free direction, wherein transmission is broken between the drive member and the intermediate transmission member and intermediate resistor.

In this way, the drive member may be rotated in the free direction without resistance from the intermediate resistor.

The transmission mechanism may further comprise a cam member to selectively create a first disengagement point between the drive member and the intermediate transmission member when the drive member is rotated in the drive direction, and close the first disengagement point when the drive member is rotated in the free direction. The first disengagement point may, more specifically, be between the cam member and the intermediate transmission member.

The drive member may have a substantially cylindrical portion, and the cam member may also be substantially cylindrical and received within the cylindrical portion of the drive member. A boss may be provided on an inner surface of a the drive member and cam surfaces provided on the outer surface of the cam member. The cam member may have a drive cam surface to engage the boss upon rotation of the drive member in the drive direction, to move the transmission mechanism to the drive state, and a free cam surface to engage the boss upon rotation of the drive member in the free direction, to move the transmission mechanism to the free state (i.e. break the transmission between the drive member and the intermediate transmission member).

Of course, other arrangements of the drive member and cam member, and the boss and cam surfaces are possible. For example, the boss may be provided on the cam member, and the cam surfaces may be provided on the drive member. Alternatively, the cam member may have a larger diameter than the drive member, with the boss located on an outer surface of the drive member, and the cam surfaces located on an inner surface of the cam member.

The winder may further comprise a biasing element to bias the intermediate transmission component and the driven member apart and create a second disengagement point between the intermediate transmission component and the driven member when the transmission mechanism is in the free state. This means that, when the transmission mechanism is in its free state, the intermediate resistor does not act to restrict rotation of the blind or resist the user operating the winder. This ensures that it does not interfere with retraction of the blind by, for example, a separate spring booster.

In a second aspect of the present invention there is provided a blind system comprising:

a first blind;

a second blind;

a first winder in accordance with the first aspect of the present invention, to operate the first blind;

a second winder in accordance with the first aspect of the present invention, to operate the second blind;

wherein rotation of the drive member of the first winder in the drive direction causes the drive member of the second winder to rotate in the free direction, and rotation of the drive member of the second winder in the drive direction causes the drive member of the first winder to rotate in the free direction.

Accordingly, it will be appreciated that when the drive member of the first winder is rotated in its drive direction, the drive member of the second winder is rotated in its free direction, and vice versa. However, only one of the intermediate resistors needs to be disengaged in order to rotate both winders. The present invention therefore provides an advantage over dual blind systems where such resistance must be overcome in both winders, regardless of which blind is being operated. Of course, the present invention also has application to single blind systems.

The blind system may further comprise a cord engaged with both the drive member of the first winder and the drive member of the second winder, wherein rotation of the drive member of the first winder in the drive direction is achieved by moving the cord in one direction, and rotation of the drive member of the second winder in the drive direction is achieved by moving the cord in the other direction.

It will be appreciated that the reference to a 'cord' in this specification encompasses various cords (including beaded cords) and chains which may be used to operate a winder for a blind system.

The blind system may further comprise:

a first position stop to hold the first blind in position, when the cord is not operated;

a second position stop to hold the second blind in position, when the cord is not operated;

a first spring booster to retract the first blind, when the first position stop is released;

and/or a second spring booster to retract the second blind, when the second position stop is released.

A detailed description of one or more embodiments of the invention is provided below, along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents.

For the purpose of example, numerous specific details are set forth in the following description in order to provide a thorough understanding of the present invention. The present invention may be practiced according to the claims without some or all of these specific details. For the purposes of clarity, technical material that is known in the technical fields related to the invention has not been described in detail so that the present invention is not unnecessarily obscured.

BRIEF DESCRIPTION OF THE DRAWINGS

Various embodiments/aspects of the invention will now be described with reference to the following drawings.

DETAILED DESCRIPTION

Figure 1:
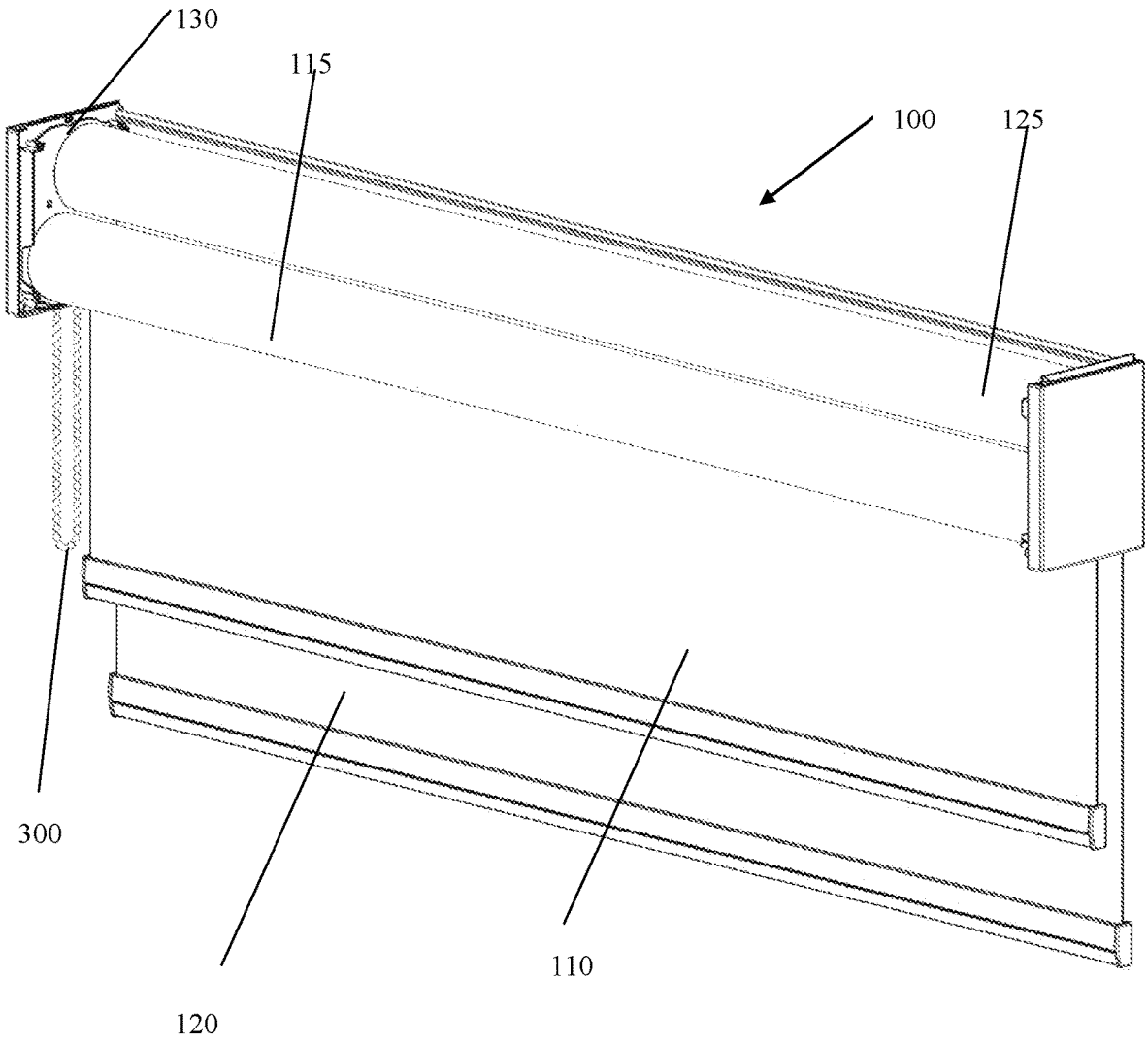
FIG. 1 is a perspective view of a dual blind system according to an embodiment of the present invention.
Figure 2:
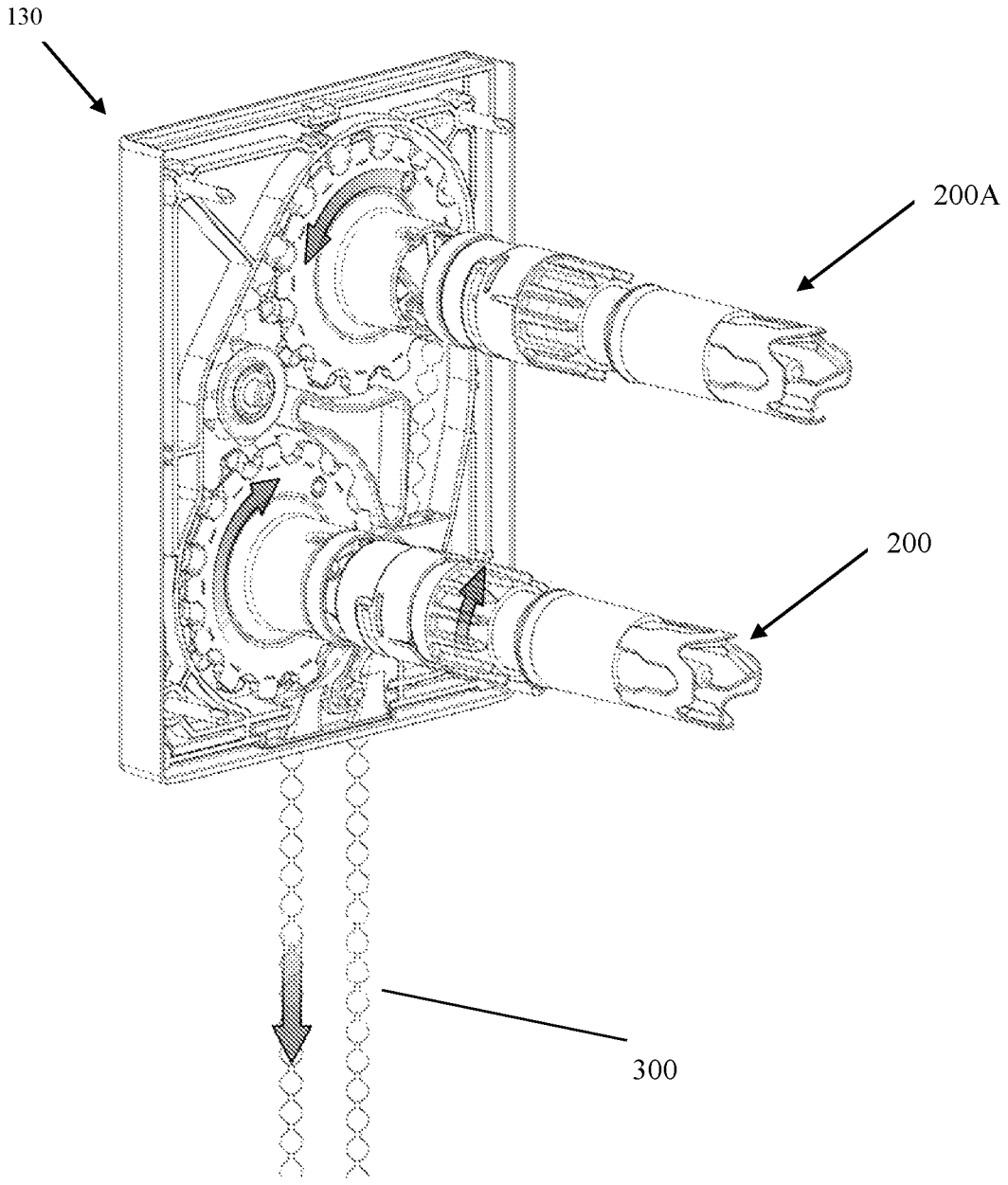
FIG. 2 is a perspective view of a dual blind winder assembly, for the blind system of FIG. 1, with arrows showing operation of the cord to extend the front blind.
Figure 3:
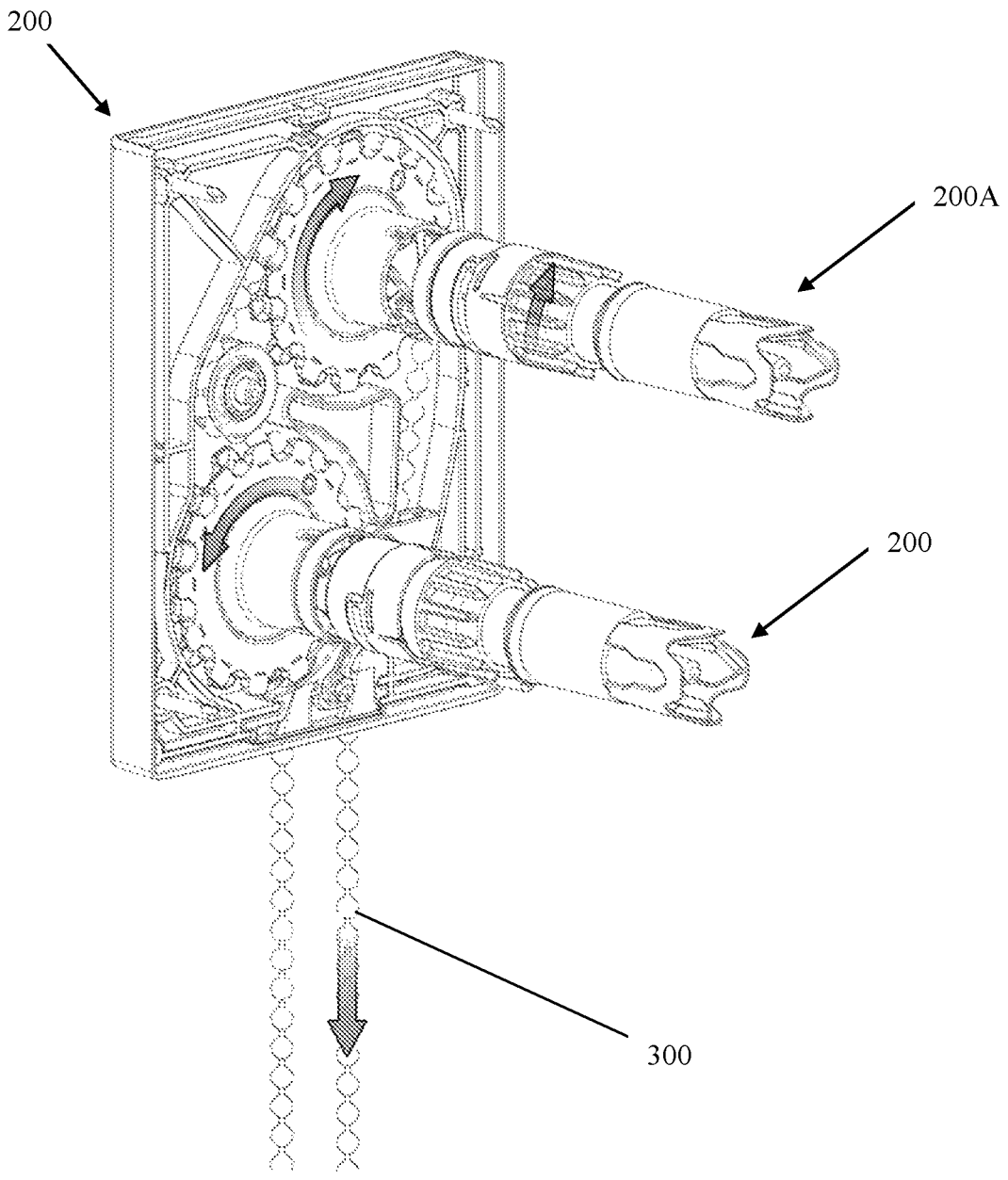
FIG. 3 is a perspective view of a dual blind winder assembly, for the blind system of FIG. 1, with arrows showing operation of the cord to extend the back blind.

FIG. 1 depicts a dual blind system 100 according to an embodiment of the present invention. The blind system 100 includes a front blind 110 and a back blind 120, each of which is extended or retracted by rotating a respective blind cylinder 115, 125. The blind cylinders are mounted on a dual blind winder assembly 130, shown separately in FIGS. 2 and 3.

The dual blind winder assembly 130 includes a pair of winders according to an embodiment of the present invention—front winder 200, and back winder 200A. A single cord 300 engages with both the front winder 200 and the back winder 200A. The front and back winders 200, 200A are identical except that they are configured to operate their respective blinds 110, 120 when the cord is pulled in different directions—as shown by the arrows in FIG. 2, pulling the cord in one direction will operate the front blind 110, and as shown by the arrows in FIG. 3, pulling the cord in the other direction will operate the back blind 120. Ordinary operation of each winder 200, 200A will extend the respective blind.

Of particular note, when the cord is pulled to operate the front blind, the back blind winder 200A spins freely without operating the back blind—when operating the front blind winder 200, the operator is not required to overcome transmission resistance (e.g. frictional resistance from a clutch spring) in the back blind winder 200A. Similarly, when the cord is pulled to operate the back blind 120, the front blind winder 200 spins freely without operating the front blind 110—when operating the back blind winder 200A, the operator is not required to overcome transmission resistance in the front blind winder 200.

In a preferred embodiment, the respective blinds are each provided with a position stop (to hold the blind in position when the cord is not being pulled) and a spring booster (to retract the blind when the respective position stop is released). The position stop may be released by tugging on the cord, in the operational direction for the respective blind.

Figure 4:
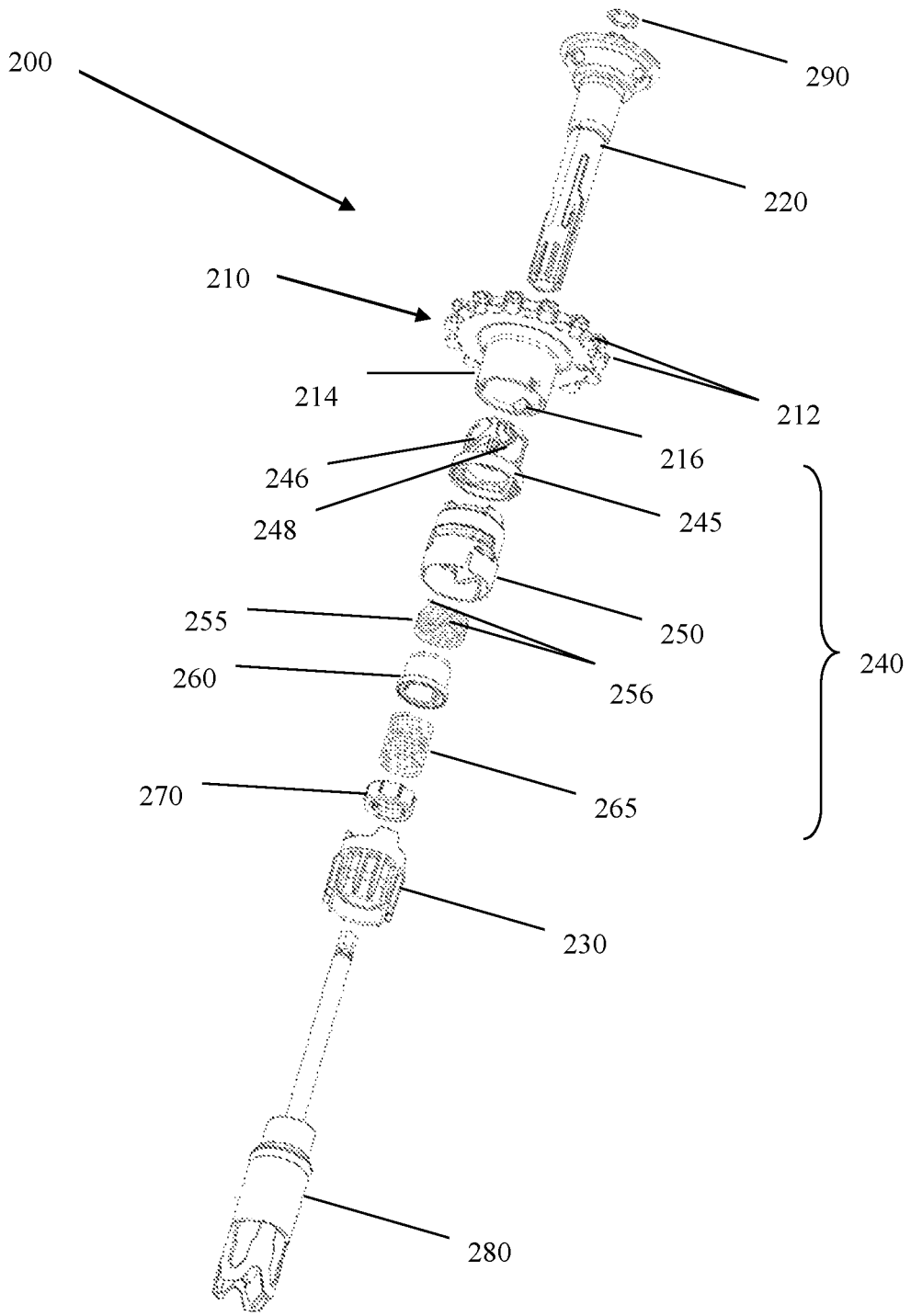
FIG. 4 is an exploded view of a winder according to an embodiment of the present invention.

FIG. 4 depicts an exploded view of the winder 200 of this embodiment of the present invention. The winder 200 includes a drive member in the form of chain wheel 210, which in use is rotatably mounted on spindle 220 and has teeth 212 which are engaged by the cord 300. The winder 200 also includes a driven member in the form of crown 230, which is engageable with a blind cylinder such that rotation of the crown 230 in the drive direction causes rotation of the blind cylinder, thereby extending the respective blind.

A transmission mechanism 240 is provided between the chain wheel 210 and the crown 230. The transmission mechanism 240 includes cam member 245, which is generally cylindrical and is received in a generally cylindrical portion 214 of the chain wheel 210.

The transmission mechanism further includes an intermediate transmission member in the form of cam drive dog 250, and an intermediate resistor in the form of a helical clutch spring 255. The clutch spring 255 locates around clutch spring bush 260, tightly enough to create friction between the clutch spring 255 and the bush 260, and one of the legs 256 of the clutch spring 255 is engaged in a slot of the cam drive dog 250. The clutch spring bush 260 is non-rotatably mounted on the spindle 220, having internal splines which engage with splines on the spindle 220 to prevent relative rotation. Therefore, in order to rotate the cam drive dog 250 and spring 255 relative to the bush 260, the frictional resistance between the clutch spring 255 and bush 260 must be overcome.

Figure 5:
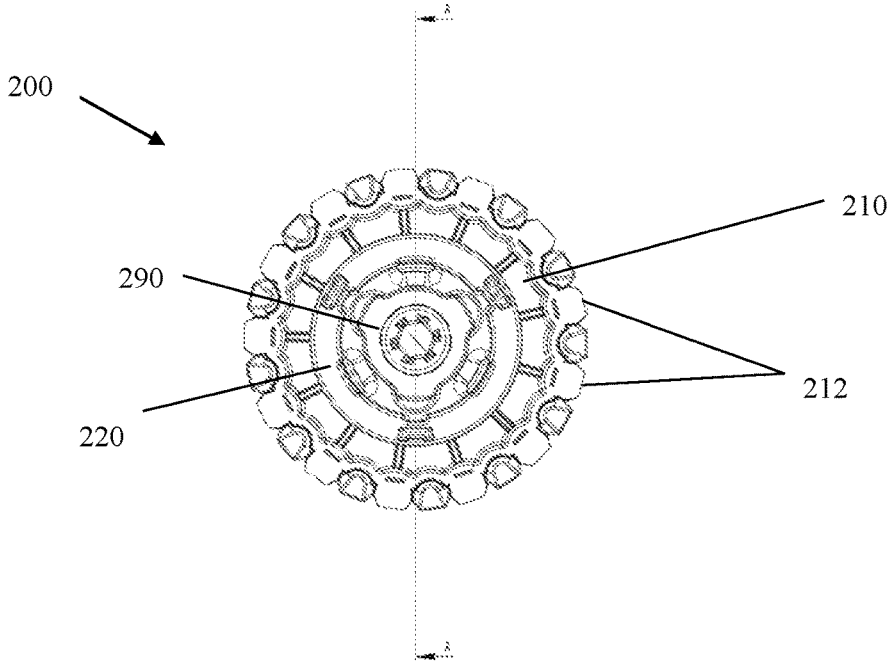
FIG. 5 is a rear view of the winder of FIG. 4, assembled.
Figure 6:
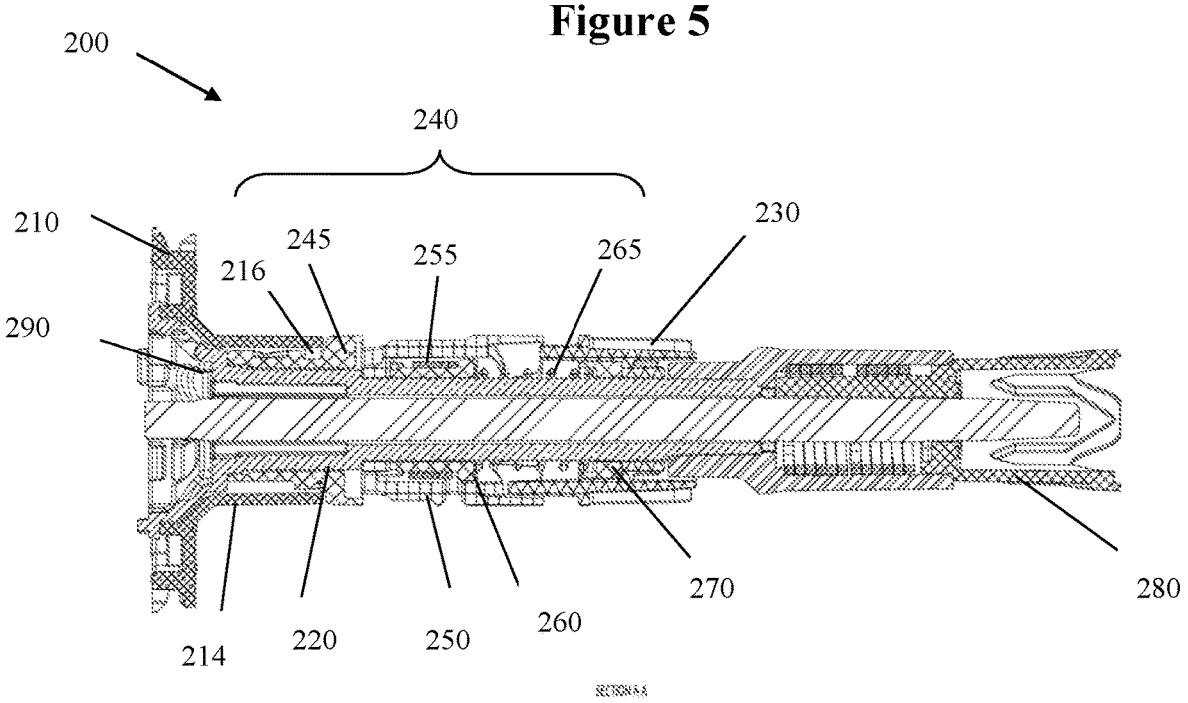
FIG. 6 is section A-A of the winder shown in FIG. 5.

A compression spring 265 and compression spring retainer 270, and when assembled, the components are secured in place by end fitting 280 and locking ring 290, as shown in FIGS. 5 and 6. Compression spring retainer 270 is a bayonet-type fitting, held in place when assembled onto the spindle 200 by twisting the retainer 270. This allows internal splines to engage in the spindle spline grooves that are closed, preventing the retainer from being pushed off the spindle by the compression spring 265.

Figure 7A:
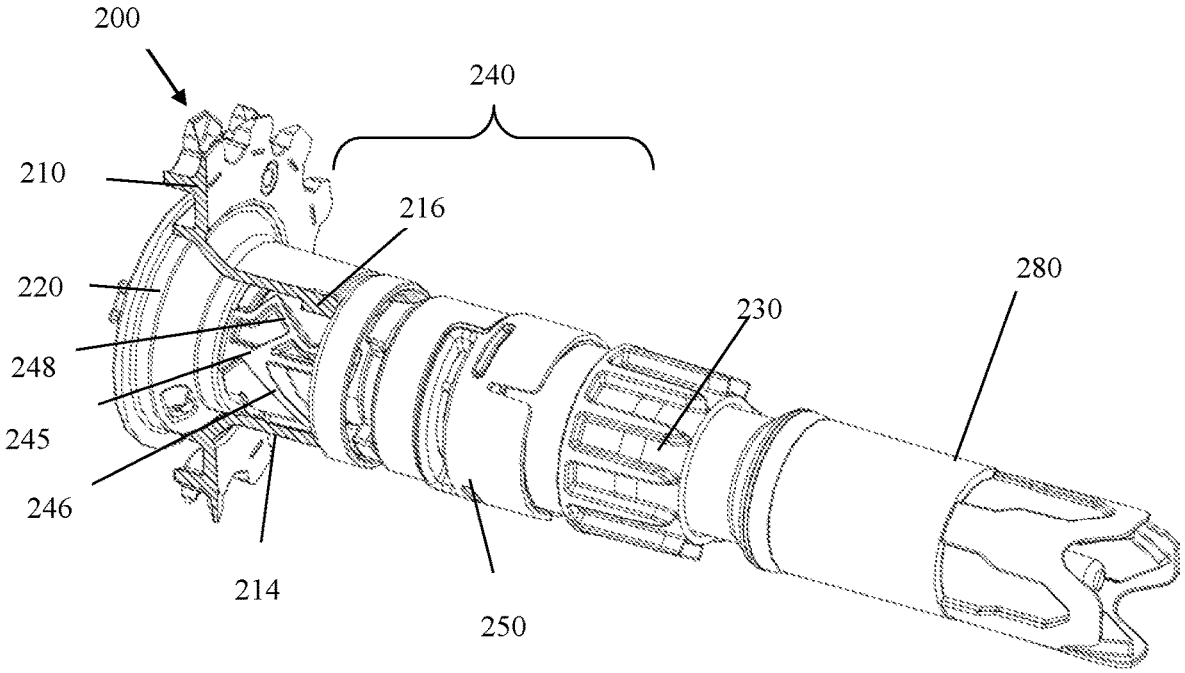
FIGS. 7A to 7D are perspective views of the winder of FIG. 4, sequentially showing its operation when the drive member is rotated in the drive direction.

The transmission mechanism 240 acts to selectively transmit rotation of the chain wheel 210 to the crown 230, and its operation is depicted in detail in FIGS. 7A to 11B. FIG. 7A depicts the winder 200 with the transmission mechanism in the free state. In the free state, the cam member 245 is engaged with the chain wheel 210, but disengaged from the intermediate transmission member, cam drive dog 250, which in turn is disengaged from the crown 230 (see also FIG. 9A). If the chain wheel 210 is rotated in the free direction, these components remain disengaged, and the chain wheel 210 can spin freely without the resistance of the clutch spring 255. Furthermore, in this free state, the crown 230 is also able to spin freely, meaning that if the position stop is released, the blind is free to retract automatically under the action of a spring booster.

Figure 7B:
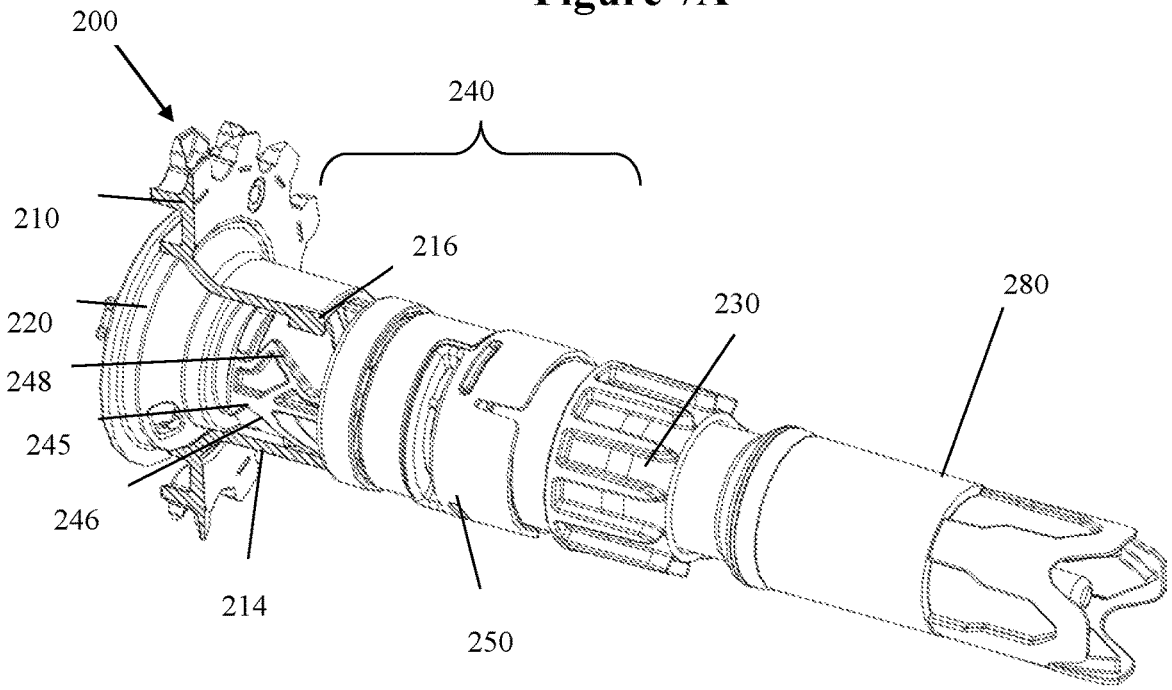
Figure 8A:
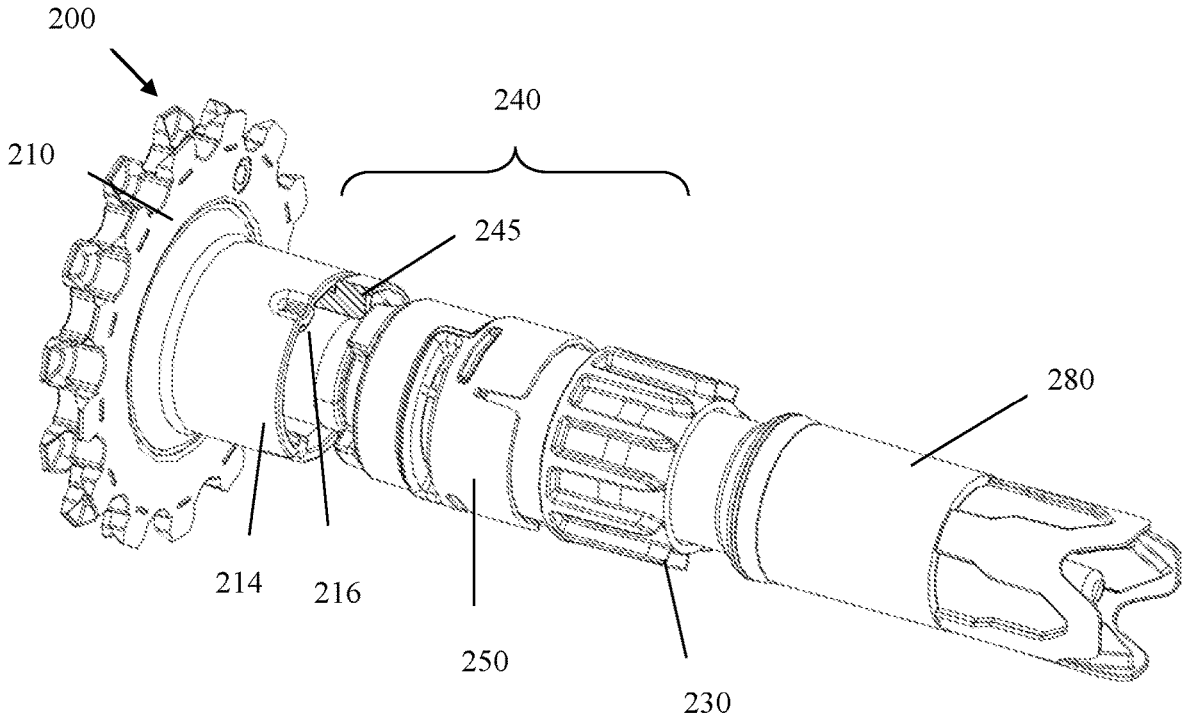
FIGS. 8A to 8C are perspective views of the winder of FIG. 4, sequentially showing its operation when the drive member is rotated in the drive direction, with components depicted as transparent so as not to obscure the operation of the cam member.
Figure 8B:
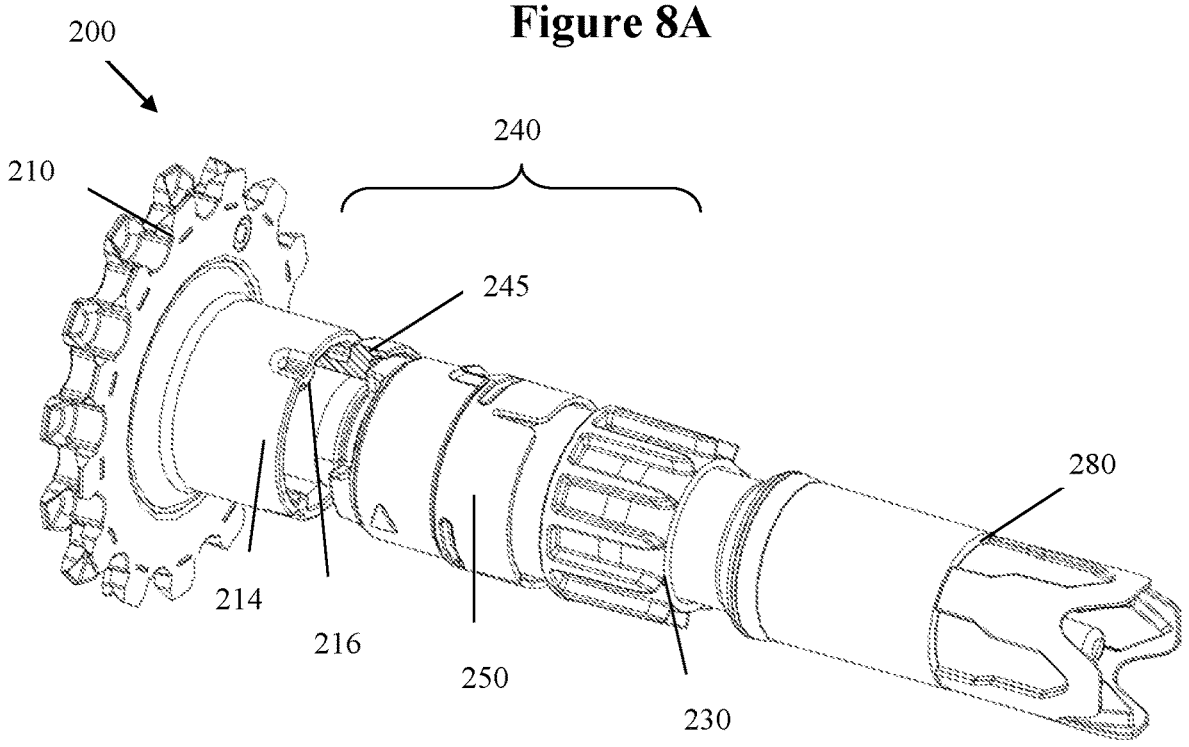
Figure 8C:
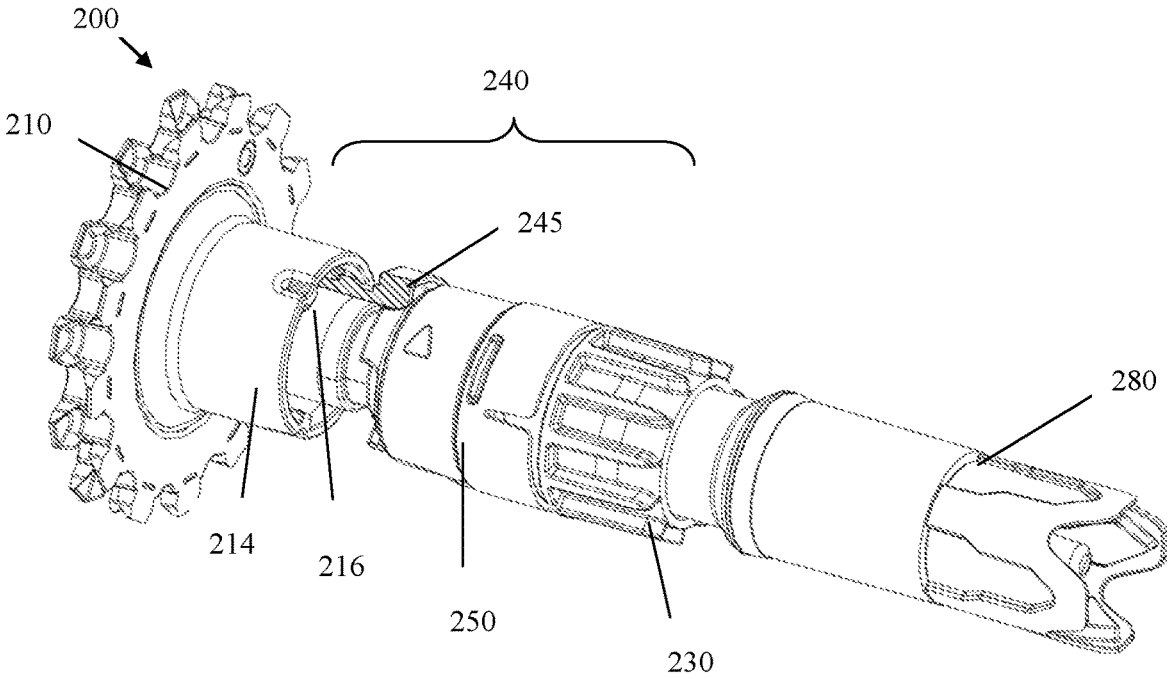
Figure 9A:
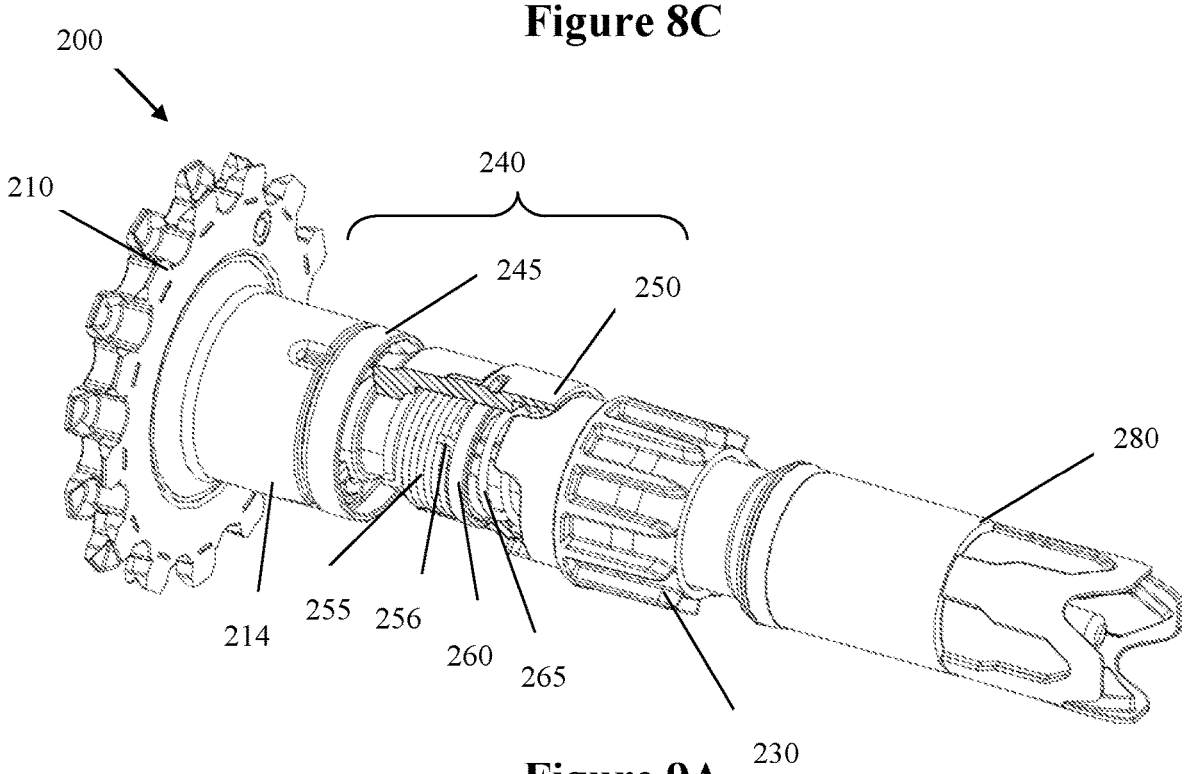
FIGS. 9A to 9B are perspective views of the winder of FIG. 4, sequentially showing its operation when the drive member is rotated in the drive direction, with components depicted as transparent so as not to obscure the operation of the cam drive dog.
Figure 9B:
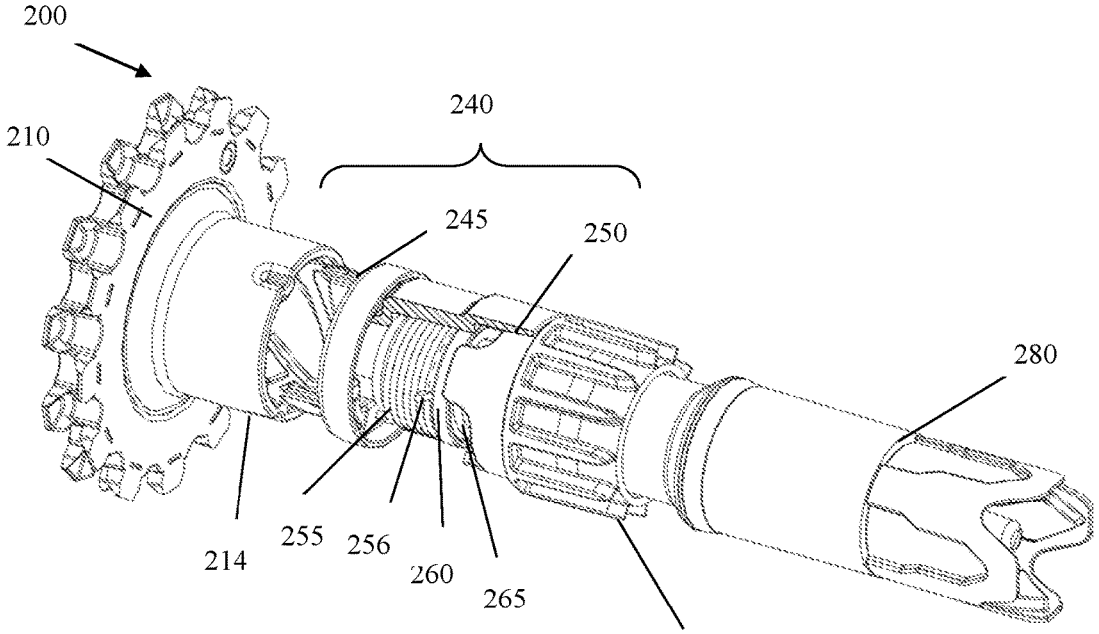
Figure 10:
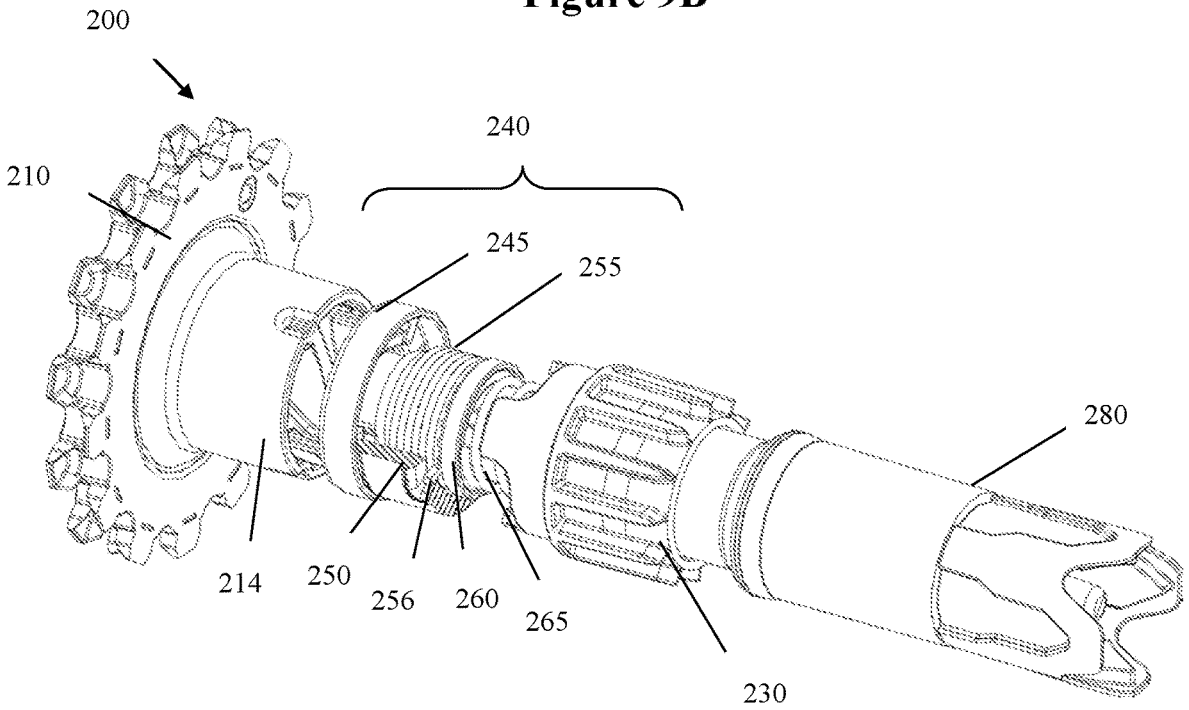
FIG. 10 is a perspective view of the winder of FIG. 4, showing its operation as the drive member is rotated in the drive direction, with components depicted as transparent so as not to obscure the operation of the clutch spring.
Figure 11A:
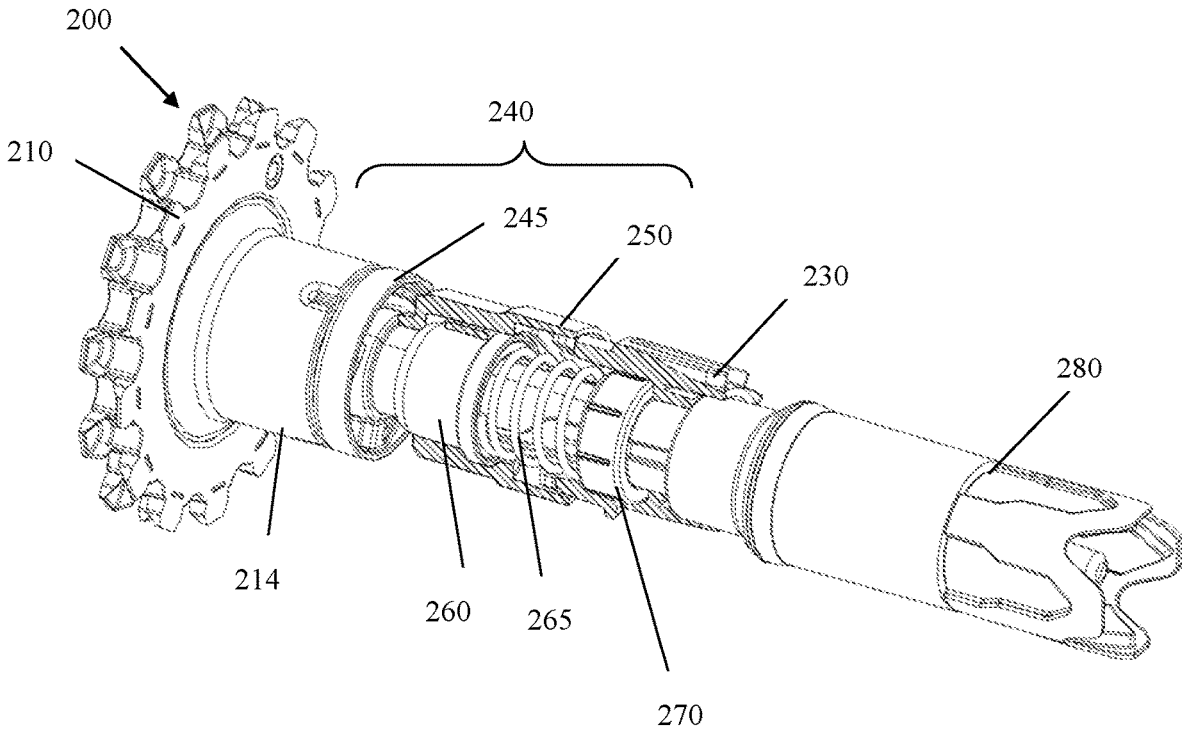
FIGS. 11A to 11B are perspective views of the winder of FIG. 4, sequentially showing its operation when the drive member is rotated in the drive direction, with components depicted as transparent so as not to obscure the operation of the cam compression spring and clutch spring bush.
Figure 11B:
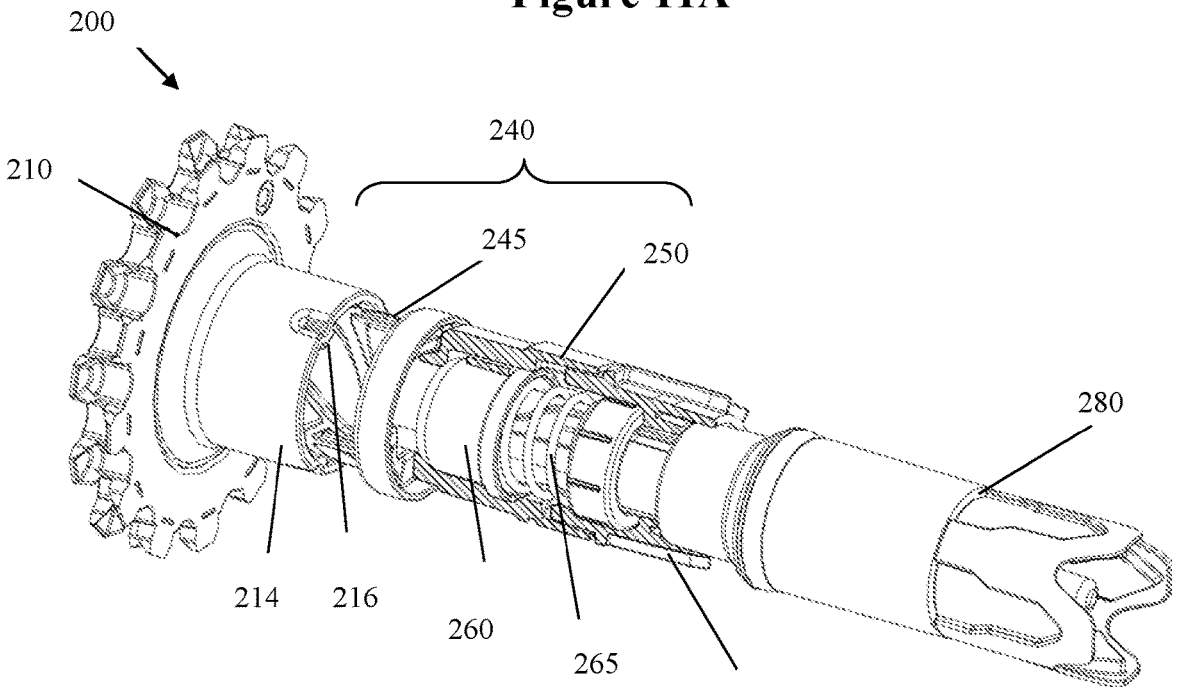

However, if the chain wheel 210 is rotated in the drive direction, this causes the transmission mechanism 240 to transition to its drive state. As best seen in FIG. 4, a boss 216 is provided on the inner surface of the cylindrical portion 214 of chain wheel 210. Furthermore, the cam member 245 has a drive cam surface 246 and a free cam surface 248 on its outer surface. When the chain wheel 210 is rotated in its drive direction, the boss 216 engages with the drive cam surface 246 and forces the cam member 245 to translate axially away from the chain wheel 210 (referring to the longitudinal axis of the spindle 220), to engage the cam drive dog 250, as shown in FIGS. 7B and 8B.

Figure 7C:
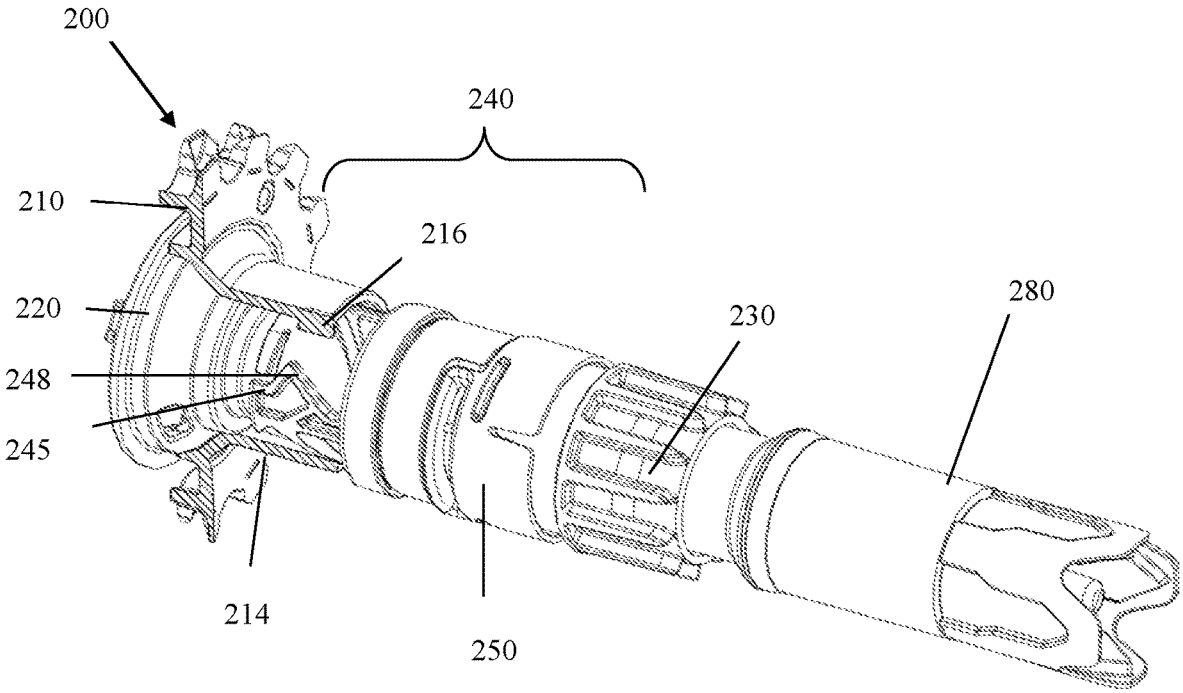
Figure 7D:
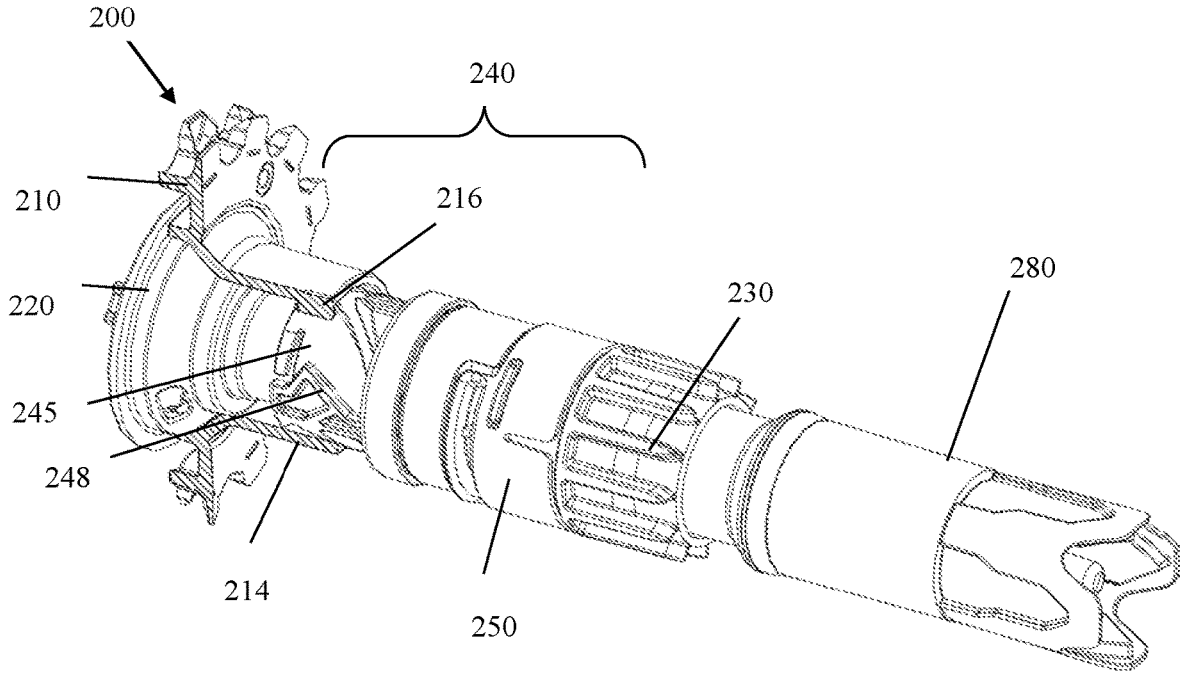

As the cam member 245 engages the cam drive dog 250, the intermediate resistor (through the outwardly protruding leg 256 of clutch spring 255) resists rotation of the cam drive dog 250, providing a secure engagement between the cam member 245 and the cam drive dog 250. As the chain wheel 210 is rotated further in the drive direction, the resistance of the clutch spring 255 results in both the cam member 245 and the cam drive dog 250 being forced further axially away from the chain wheel 210, also forcing the clutch spring bush 260 axially and compressing the compression spring 265 (see FIG. 11B). This continues until the cam drive dog 250 engages the crown 230 as shown in FIGS. 7C to 7D (see also FIGS. 8C, 9B, 11B). The transmission mechanism 240 is then fully in its drive state, and further rotation of the chain wheel 210 is transmitted to the crown 230, resulting in consequent extension of the blind.

When the cord 300 is released, rotation of the chain wheel 210 stops and the compression spring forces the transmission mechanism 240 back to its free state. Subsequent rotation of the chain wheel 210 in the free direction will result in the boss 216 engaging the free cam surface 248 of the cam member 245, moving the cam member 245 further away from the cam drive dog 250 and ensuring that the drive member is disengaged. Therefore, the drive member may be rotated in the free direction without needing to release the clutch spring 255 (i.e. the clutch spring 255 can remain engaged).

Figure 12:
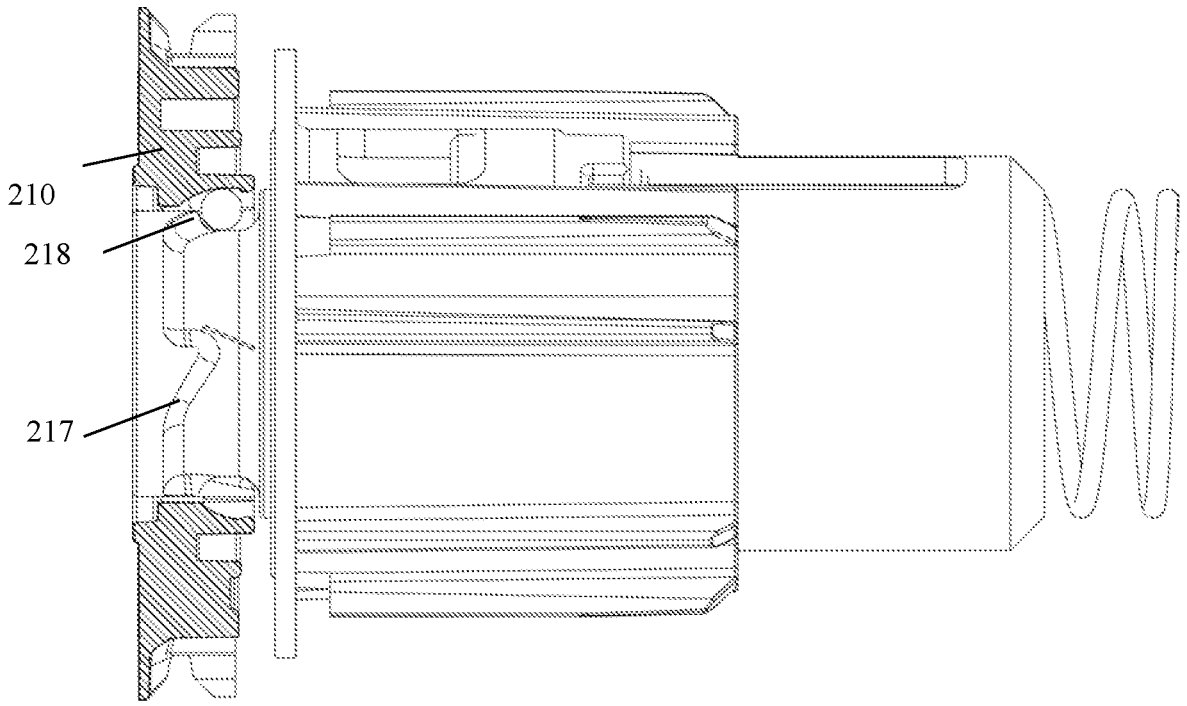
FIG. 12 depicts a winder according to an alternative embodiment of the present invention.

Finally FIG. 12 depicts an alternative embodiment of the present invention, which uses a different mechanism to translate the cam member 245 axially. In this embodiment, instead of boss 216, a ball bearing 218 is used that runs inside a track 217 on both the wheel 210 and cam member 245. Rotation of the chain wheel 210 will cause the ball 218 to move within the track 217. As the ball 218 moves along the path of the track, depending on the rotation direction, the angled or helical groove on the inside of the chain wheel will direct the ball to either side of the track. For rotation in the drive direction, on the left side of the track (as shown in FIG. 12), the ball will lodge in a pocket, thus engaging the drive (i.e. the transmission mechanism is moved to its drive state). If the drive member is rotated in the free direction, the ball will move to the other side of the track which is free to rotate without hindrance.

The word 'comprising' and forms of the word 'comprising' as used in this description and in the claims does not limit the invention claimed to exclude any variants or additions.

Modifications and improvements to the invention will be readily apparent to those skilled in the art. Such modifications and improvements are intended to be within the scope of this invention.

For example, different drive members could be used in other embodiments of the present invention, such as a ratchet mechanism or a spring loaded pull cord.

The invention claimed is:

1. A winder for a blind system, comprising:

a drive member rotatable in a drive direction and a free direction;

a driven member to engage a blind cylinder;

a transmission mechanism to selectively transmit rotation of the drive member to the driven member, the transmission mechanism including a cam member, an intermediate transmission member and an intermediate resistor to provide resistance to rotation of the intermediate transmission member, wherein the transmission mechanism has:

a drive state when the drive member is rotated in the drive direction to overcome the resistance of the intermediate resistor and transmit rotation of the drive member through the intermediate transmission member to the driven member, and a free state when the drive member is rotated in the free direction, wherein transmission is broken between the drive member and the intermediate transmission member and between the drive member and the intermediate resistor.

2. A winder according to claim 1, wherein the cam member selectively creates a first disengagement point between the drive member and the intermediate transmission member when the drive member is rotated in the free direction, and closes the first disengagement point when the drive member is rotated in the drive direction.

3. A winder according to claim 2, wherein one of the drive member and the cam member comprises a boss, and the other of the drive member and the cam member comprises a drive cam surface to engage the boss upon rotation of the drive member in the drive direction, to move the transmission mechanism to the drive state.

4. A winder according to claim 3, wherein the other of the drive member and the cam member further comprises a free cam surface to engage the boss upon rotation of the drive member in the free direction, to move the transmission mechanism to the free state.

5. A winder according to claim 3, wherein the boss is on the drive member.

6. A winder according to claim 5, wherein the boss is on an inner surface of the drive member.

7. A winder according to claim 1, further comprising a biasing element to bias the intermediate transmission member and the driven member apart and create a second disengagement point between the intermediate transmission member and the driven member when the transmission mechanism is in the free state.

8. A winder according to claim 7, wherein the biasing element is a compression spring.

9. A winder according to claim 1, wherein the intermediate resistor comprises a helical spring.

10. A winder according to claim 1, wherein the drive member comprises a chain wheel.

11. A blind system comprising:

a first blind;

a second blind;

a first winder in accordance with claim 1, to operate the first blind;

a second winder in accordance with claim 1, to operate the second blind, wherein rotation of the drive member of the first winder in the drive direction causes the drive member of the second winder to rotate in the free direction, and rotation of the drive member of the second winder in the drive direction causes the drive member of the first winder to rotate in the free direction.

12. A blind system according to claim 11, wherein the blind system further comprises a cord engaged with the drive member of the first winder and the drive member of the second winder, wherein rotation of the drive member of the first winder in the drive direction is achieved by moving the cord in one direction, and rotation of the drive member of the second winder in the drive direction is achieved by moving the cord in the other direction.

13. A blind system according to claim 11, further comprising a first position stop to hold the first blind in position, when the cord is not operated.

14. A blind system according to claim 13, further comprising a first spring booster to retract the first blind, when the first position stop is released.

15. A blind system according to claim 13, further comprising a second position stop to hold the second blind in position, when the cord is not operated.

16. A blind system according to claim 15, further comprising a second spring booster to retract the second blind, when the second position stop is released.

17. A winder for a blind system, comprising:

a drive member rotatable in a drive direction and a free direction;

a driven member to engage a blind cylinder;

a transmission mechanism to selectively transmit rotation of the drive member to the driven member, the transmission mechanism including a cam member, an intermediate transmission member and an intermediate resistor to provide resistance to rotation of the intermediate transmission member, wherein the transmission mechanism has:

a drive state when the drive member is rotated in the drive direction to overcome the resistance of the intermediate resistor and transmit rotation of the drive member through the intermediate transmission to the driven member, and a free state when the drive member is rotated in the free direction, wherein transmission is broken between the drive member and the intermediate transmission member and between the drive member and the intermediate resistor;

wherein there is no clutch resistance to rotation of the drive member in the free direction when the transmission mechanism is in the free state.

18. A winder according to claim 17, wherein the cam member selectively creates a first disengagement point between the drive member and the intermediate transmission member when the drive member is rotated in the free direction, and closes the first disengagement point when the drive member is rotated in the drive direction.

19. A winder according to claim 18, wherein one of the drive member and the cam member comprises a boss, and the other of the drive member and the cam member comprises a drive cam surface to engage the boss upon rotation of the drive member in the drive direction, to move the transmission mechanism to the drive state.

20. A winder according to claim 19, wherein the other of the drive member and the cam member further comprises a free cam surface to engage the boss upon rotation of the drive member in the free direction, to move the transmission mechanism to the free state.

21. A winder according to claim 19, wherein the boss is on the drive member.

22. A winder according to claim 21, wherein the boss is on an inner surface of the drive member.

23. A winder according to claim 17, further comprising a biasing element to bias the intermediate transmission member and the driven member apart and create a second disengagement point between the intermediate transmission member and the driven member when the transmission mechanism is in the free state.

24. A winder according to claim 23, wherein the biasing element is a compression spring.

25. A winder according to claim 17, wherein the intermediate resistor comprises a helical spring.

26. A winder according to claim 17, wherein the drive member comprises a chain wheel.

* * * * *